US011532194B2

(12) United States Patent
Li et al.

(10) Patent No.: US 11,532,194 B2
(45) Date of Patent: Dec. 20, 2022

(54) KNOCK DETECTION DEVICE AND HOUSEHOLD APPLIANCE INCLUDING THE SAME

(71) Applicant: Diehl AKO Stiftung & Co. KG, Wangen (DE)

(72) Inventors: Zhongke Li, Nanjing (CN); Shuhai Fan, Nanjing (CN)

(73) Assignee: Diehl AKO Stiftung & Co. KG, Wangen (DE)

( * ) Notice: Subject to any disclaimer, the term of this patent is extended or adjusted under 35 U.S.C. 154(b) by 0 days.

(21) Appl. No.: 17/213,583

(22) Filed: Mar. 26, 2021

(65) Prior Publication Data

US 2021/0312742 A1 Oct. 7, 2021

(30) Foreign Application Priority Data

Apr. 3, 2020 (CN) ..... 202020478733.7

(51) Int. Cl.
*G07C 9/30* (2020.01)
*G10L 25/51* (2013.01)

(52) U.S. Cl.
CPC ..... *G07C 9/30* (2020.01); *G10L 25/51* (2013.01)

(58) Field of Classification Search
CPC ..... G07C 9/30; G10L 25/51
See application file for complete search history.

(56) References Cited

U.S. PATENT DOCUMENTS

2020/0363857 A1* 11/2020 Kosugi ..... G06F 1/3231
2021/0144499 A1* 5/2021 Bulek ..... H04R 29/002
2021/0217438 A1* 7/2021 Mensah ..... G10L 25/51
2021/0270519 A1* 9/2021 Yoon ..... F25D 29/00

FOREIGN PATENT DOCUMENTS

KR 2096957 B1 * 4/2020 ..... F25D 23/028

OTHER PUBLICATIONS

English Translation of KR-2096957 Apr. 2020.*

* cited by examiner

*Primary Examiner* — Nabil H Syed
(74) *Attorney, Agent, or Firm* — Laurence A. Greenberg; Werner H. Stemer; Ralph E. Locher

(57) ABSTRACT

A knock detection device includes a proximity sensor, at least one sound sensor, and a signal processing unit. The proximity sensor and the sound sensor are respectively electrically connected to the signal processing unit. The signal processing unit receives and/or processes the signal of the sound sensor according to the signal of the proximity sensor. A household appliance includes the knock detection device. The knock detection device is disposed inside the household appliance on the back side of a panel provided for knocking by a user.

15 Claims, 2 Drawing Sheets

KNOCK DETECTION DEVICE AND HOUSEHOLD APPLIANCE INCLUDING THE SAME

CROSS-REFERENCE TO RELATED APPLICATION

This application claims the priority, under 35 U.S.C. § 119, of Chinese Patent Application CN 202020478733.7, filed Apr. 3, 2020; the prior application is herewith incorporated by reference in its entirety.

BACKGROUND OF THE INVENTION

Field of the Invention

The present invention relates to a knock detection device and a household appliance including the same.

Description of the Related Art

At present, the door of a household appliance is usually opened by a door handle. With the development of society, there are higher requirements for aesthetic effect and convenient use of a household appliance. At the same time, the door handle of a household appliance, such as a refrigerator or a washing machine, is the position at which the user touches the appliance with high frequency, so that it is likely to conceal or contain dirt and lead to poor sanitary conditions. In the case where there is no door handle, it is more likely to realize an integrated construction, thereby producing a more aesthetic look.

Since it is a conventional movement to inform a person of opening the door to a room by knocking, it is conceivable to open the door of a household appliance by knocking.

However, for a household appliance such as a washing machine, there are vibrations and noises which occur during the operation of the household appliance. Known technical solutions for opening a door by knock detection are likely to be interfered with by vibrations and noises of the household appliance. Therefore, the known technical solutions are often not allowed to be applied to a household appliance that requires high safety, because the internal vibration thereof or the external interference might be mistakenly recognized as a knock made by the user, thereby falsely triggering an operation that is not desired by the user. Accordingly, it is possible to lead to damage to the functionality and reliability of the household appliance.

BRIEF SUMMARY OF THE INVENTION

It is accordingly an object of the invention to provide a knock detection device and a household appliance including the same, which overcome the hereinafore-mentioned disadvantages of the heretofore-known devices and appliances of this general type and in which the knock detection device is highly sensitive, reliable, simple in structure and easily manufactured.

With the foregoing and other objects in view there is provided, in accordance with the invention, a knock detection device which comprises a proximity sensor, at least one sound sensor and a signal processing unit, the proximity sensor and the sound sensor are respectively electrically connected to the signal processing unit, and the signal processing unit receives and/or processes a signal of the sound sensor according to a signal of the proximity sensor.

In the present disclosure, the sound sensor detects sound waves caused by knocking, and the sound waves cause the sound sensor to generate signals. In particular, the sound sensor according to the present disclosure cannot be in direct contact with a surface to be detected, so that it can be less affected by humidity of the latter, a knocking force, and the like. Therefore, the knock detection device can be widely suitable for panels for knocking made of various materials.

According to the present disclosure, the proximity sensor detects the presence and/or movement of the user. The signal processing unit receives and/or processes the signal of the sound sensor according to the signal of the proximity sensor. For example, it is only when the signal of the proximity sensor is at a high level, that the signal of the sound sensor is input into the signal processing unit, or the signal processing unit processes the signal of the sound sensor. In this case, it is possible to consider using a switching device such as a triode and MOSFET which can be controlled by the signal of the proximity sensor, and it is also possible to use an operational amplifier circuit or a logic gate and the like. In other words, the knock detection device according to the present disclosure can detect whether the presence and/or movement of the user is in the vicinity of the knock detection device or the household appliance to distinguish whether the sound wave to be detected or already detected is generated by knocking of the user or caused by the internal vibration or the external interference during the operation of the household appliance, so as to avoid an undesired response such as sudden abortion of the household appliance in an operating state in the case that the user does not perform a knocking operation.

In the scope of the present disclosure, the signal processing unit can be implemented not only as an analog circuit such as a comparator circuit and an operational circuit, but also as a digital circuit such as an integrated circuit, a system on a chip, a programmable logic element or a field programmable gate array with a microprocessor. Preferably, the signal processing unit is implemented as a circuit board on which the proximity sensor and the sound sensor are disposed.

The knock detection device according to the present disclosure can detect whether the user is in the vicinity of the detection device and can regard this as a condition for determining a knock, so that a knock is detected only when there is actually an operation by a user. In this way, it is possible to effectively avoid false triggering caused by the vibration or noise interference in the internal or external environment of the household appliance, thereby realizing knock detection with higher reliability. Based on the result of knock detection, it is possible to realize a corresponding functional response, for example to open the door of the household appliance. In addition, the present disclosure can also maintain its overall structure to be simple and easily manufactured while improving the sensitivity and reliability of the knock detection device.

In particular, such a knock detection device can be modularly constructed in mass production, and integrally mounted in the household appliance as a module or an assembly, thereby presenting high conformity, stability and reliability. It may be considered that a plurality of knock detection devices can be mounted in one household appliance. For example, a plurality of knock detection devices may be mounted on different sides of the household appliance.

According to one embodiment of the present disclosure, the proximity sensor and/or the sound sensor is/are at least partially surrounded by a support structure. In a mounted state, the support structure can provide support and/or protection for the proximity sensor and/or the sound sensor. In addition, the environmental interference is also reduced by the support structure.

Preferably, the support structure is higher than the proximity sensor and/or the sound sensor, or the support structure is flush with the proximity sensor and/or the sound sensor. In other words, the end of the support structure surrounding the proximity sensor is higher than or equal to the top end of the proximity sensor, and/or the end of the support structure surrounding the sound sensor is higher than or equal to the top end of the sound sensor. In this way, the spacing between the proximity sensor and/or the sound sensor and the panel for knocking is preserved to prevent direct contact therebetween, thereby avoiding the impact of the proximity sensor and/or the sound sensor on the panel caused by the internal vibration of the household appliance or the external interference, and protecting the components of the knock detection device. Moreover, the end of the support structure surrounding the sound sensor is preferably higher than the top end of the sound sensor, so as to prevent the sound sensor from being in direct contact with the panel to produce sound transmission between solids. Accordingly, it is possible to avoid damaging the sound sensor when there is an excessive amplitude of the internal vibration or the external interference.

Further preferably, the support structure surrounding the proximity sensor has an inclined and particularly outwardly inclined side wall, and/or the support structure surrounding the proximity sensor forms a cavity structure. In order to optimize the detection effect, the angle at which the proximity sensor transmits and receives signals can be configured by defining the inclination angle of the sidewall, thereby specifically detecting the proximity and/or movement of the user. Accordingly, the support structure surrounding the sound sensor can form a resonant cavity for sound resonance. The size of the support structure can be chosen correspondingly to the frequency range of the sound wave to be detected (i.e., the sound wave generated by knocking), so as to more specifically detect a knock. In this case, even the analog and/or digital amplifier circuit in the signal processing unit can be omitted, thereby further lowering the complexity of the knock detection device and reducing the manufacturing cost.

In particular, the support structure can be made of plastic or foam.

According to one embodiment, the knock detection device is mounted with its support structure on the back side of the panel for knocking. The fitting surface of the knock detection device is conveniently produced by the support structure. The knock detection device can be easily mounted on the back side of the panel for knocking by providing a connecting portion such as an adhesive portion or a welded portion on the end of the support device. In this case, the area of the household appliance for interaction with the user is defined as the front side of the panel for knocking, while the side facing away from the user during use is defined as the back side of the panel for knocking.

In the scope of the present disclosure, the proximity sensor can be an eddy current type, capacitive type, inductive type, thermal inductive type, magnetic type, ultrasonic type, photoelectric type or microwave radar type proximity sensor. In this case, the proximity sensor can be understood as a sensor for the purpose of detection without contact with an object to be detected, which can detect the movement information and presence information of the object and convert them into signals. The signal of the proximity sensor can be an analog signal or a digital signal.

Particularly preferably, for example, a proximity sensor based on the infrared reflection principle is used. The proximity sensor uses an infrared LED and an infrared receiving tube to detect the presence and/or movement of the user based on the infrared reflection principle (in this case referring to the case where proximity to or even touch of knock sensor or the panel for knocking by the user's hand). In this case, the proximity sensor can include one infrared LED and at least one infrared receiving tube. Preferably, at least the infrared light emitting tube is provided with a light limiting structure, so as to avoid light leakage from the infrared LED to the infrared receiving tube. The angle of the received light is also limited to reduce the interference of ambient light if necessary. Such a proximity sensor based on the infrared reflection principle controls the proximity range detected by the proximity sensor in a simple manner, thus avoiding false triggering caused by unintentional pass-by of the user during operation of the household appliance. Further, it is also possible to reduce the manufacturing cost. However, it is also conceivable that the proximity sensor based on the infrared reflection principle is also provided with a gesture recognition function and/or a touch recognition function. Accordingly, knock detection and gesture control and/or touch control are simultaneously realized by using the same module, so as to form a highly integrated control module, which can accomplish more abundant functional responses and controls.

In the scope of the present disclosure, the sound sensor can be a microphone or a piezoelectric sensor. Particularly, the microphone is a MEMS (Micro-Electro-Mechanical System) microphone or an ECM (Electret Condenser Microphone). In this case, it is preferable to use the microphone as the sound sensor, since the microphone has a relatively small volume and lower requirements for the area of the sound-receiving portion, and it is possible to realize a small and integrated knock detection module.

According to one embodiment of the present disclosure, the microphone is configured as bottom-receiving microphone, and its sound-receiving portion is aligned with the panel for knocking through a hole in the signal processing device. Generally, the sound sensor is divided into a top sound-receiving type or a bottom sound-receiving type. In the case of bottom sound-receiving, the sound sensor can be attached to the signal processing device configured as a circuit board on its back side. A hole for sound-receiving is reserved in the signal processing device such that the sound-receiving portion of the microphone of a bottom sound-receiving type is aligned with the panel for knocking through the hole to receive the sound. In this embodiment, the sound sensor can be conveniently spaced apart from the panel for knocking. In addition, in the case that the support structure forming a cavity structure is provided, it is also possible to not occupy the volume of the cavity structure.

According to one embodiment of the present disclosure, a plurality of, particularly two, sound sensors are disposed around the proximity sensor. In this case, the plurality of sound sensors correspondingly form a plurality of detectable knock areas. Accordingly, the knock detection device can recognize knocks on different knock areas. Preferably, one sound sensor is disposed on both sides of the proximity sensor such that each sound sensor detects a knock on its side, so that it is possible to recognize at least two different knocking operations and respectively configure different trigger commands for these knocking operations.

According to one embodiment of the present disclosure, the knock detection device further includes a sound-proof layer composed of potting sealant, conformal coating, double-sided adhesive tape or foam. On one hand, the sound-proof layer can be physically sound-proof or protected from the interference of the sensor by the noise of the external environment and the interference of the vibration of the surface to be detected, thereby avoiding false recognition and improving the recognition accuracy. On the other hand, the sound-proof layer can reduce the physical harm to the knock detection device caused by a knock beyond a specified range. Particularly, the sound-proof layer composed of double-sided adhesive tape can adhere to the knock detection device together with the surface to be detected while realizing a sound-proof and vibration-proof mounting, so that other connection measures between the knock detection device and the surface to be detected can be omitted. The sound-proof layer can also serve as a rear cover of the knock detection device to avoid dust pollution in the external environment and produce a protective effect.

With the objects of the invention in view, there is also provided a household appliance comprising the knock detection device described above. The knock detection device is disposed inside the household appliance on the back side of the panel for knocking. In this case, the knock detection device is configured to detect a knocking operation on the panel of the household appliance. The knocking operation can trigger a function of the household appliance such as door open, power-on, start, turn up, turn down, confirm, pause, resume, stop and so on.

According to one embodiment of the present disclosure, the knocking detection device is connected to the back side of the panel of the household appliance by clamping, snap connection, thread connection, adhesive connection, rivet connection or welding connection. Preferably, the connection between the knock detection device and the back side of the panel of the household appliance is performed by using the support structure. The fitting surface of the knock detection device can be conveniently produced by the support structure.

According to one embodiment of the present disclosure, the knock detection device recognizes at least one of the following taps on the panel of the household appliance: single-contact tap, multi-contact tap, single tap, multiple taps, tap at a specific beat.

It should be noted that there are also extensive types of touch objects for performing knocking. For example, the touching objects can involve a plurality of different types of objects, which can be, for example, human body such as fingers (including fingers with gloves); non-conductive objects such as plastic objects or wood articles; or conductive objects such as metal rods and so on. Herein, the single-contact tap represents that the touching object (hand or other object) taps the panel at one point on the panel. The multi-contact tap means that the touching object taps the panel simultaneously or sequentially at a plurality of points on the panel. The single tap represents that the touching object only taps the panel once within a certain period of time, and the plural tap represents that the touching object taps the detection panel more than once within a certain period of time. The tap at a specific beat represents that the touching object taps the panel for a plurality of times at a particular interval within a certain period of time, for example, first at a short interval and then followed by a long interval between three consecutive taps. The above-described tapping modes can be performed individually and/or in combination with one another to realize different responses. The manufacturer or user can define corresponding functional responses according to different tapping modes. For example, by performing single-contact tap once, it is possible to open the door of the household appliance, and by performing single-contact tap twice, it is possible to close the door of the household appliance again. Accordingly, the door handle is no longer required in the household appliance, thereby improving the aesthetic look and convenient use of the household appliance.

According to one embodiment of the present disclosure, the household appliance is a range hood, a refrigerator, an oven, a food processor, a washing machine, an intelligent faucet or an intelligent toilet, etc.

Other features which are considered as characteristic for the invention are set forth in the appended claims.

Although the invention is illustrated and described herein as embodied in a knock detection device and a household appliance including the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

As an introduction, first of all, it should be noted that: among the different descriptions of various embodiments, the same elements are provided with the same reference signs or the same technical terms, so that the disclosure contained in the entirety of the Specification can be semantically transferred for use to the same elements provided with the same reference signs or the same technical terms.

Figure 1:
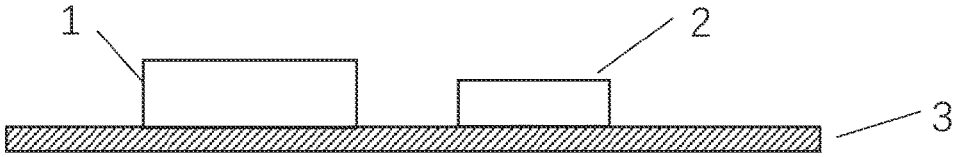
FIG. 1 is a diagrammatic, cross-sectional view of a first embodiment of the knock detection device.

Referring now to the figures of the drawings in detail and first, particularly, to FIG. 1 thereof, there is seen a cross-sectional view of a first embodiment of the knock detection device according to the present disclosure. The knock detection device includes: a proximity sensor 1, a sound sensor 2 and a signal processing unit 3, wherein the proximity sensor 1 and the sound sensor 2 are respectively electrically connected to the signal processing unit 3. In this case, the signal processing unit 3 is implemented as a circuit board on which the proximity sensor and the sound sensor are disposed. The signal processing unit 3 receives and/or processes the signal of the sound sensor 2 according to the signal of the proximity sensor 1.

Figure 2:
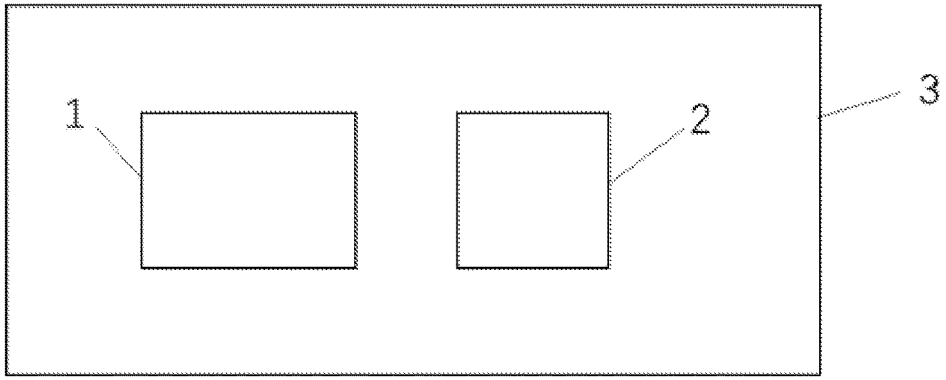
FIG. 2 is a top-plan view of the first embodiment of the knock detection device.

FIG. 2 shows a top view of the first embodiment of the knock detection device according to the present disclosure. As can be seen from FIG. 2, the proximity sensor 1 and the sound sensor 2 are disposed on the signal processing unit 3.

Figure 3:
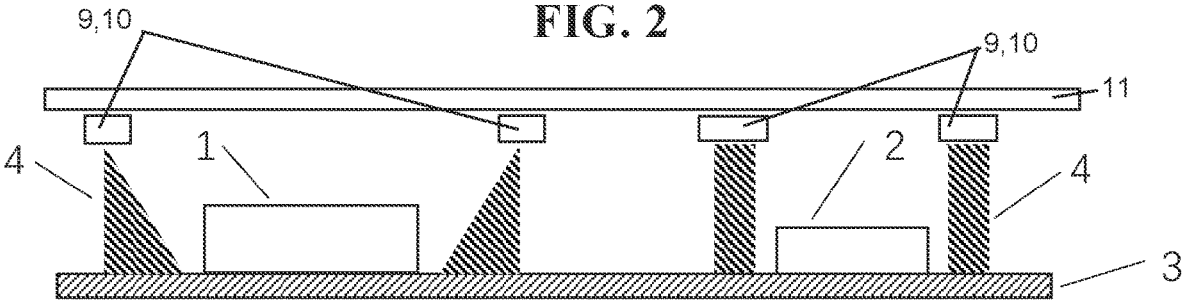
FIG. 3 is a cross-sectional view of a second embodiment of the knock detection device.

FIG. 3 shows a cross-sectional view of a second embodiment of the knock detection device according to the present disclosure. The proximity sensor 1 and/or the sound sensor 2 are at least partially surrounded by a respective support structure 4. In this case, the support structure 4 is open at the top. In this case, the support structure 4 surrounding the proximity sensor 1 has an inclined inner side wall, and the support structure 4 surrounding the proximity sensor 1 has a vertical side wall. In this case, a fan-shaped sensing range can be defined for the proximity sensor 1 by the inclined inner side wall, and a cavity structure can be defined for the sound sensor 2 by combining the vertical side wall with a panel 11 provided for knocking of the household appliance to be connected. A sound-proof layer 9 composed of potting sealant, conformal coating, double-sided adhesive tape or foam is disposed above the support structure 4. The sound-proof layer 9 is connected to the back side of the panel 11 by a clamping, snap, threaded, adhesive, rivet or welding connection 10.

Figure 4:
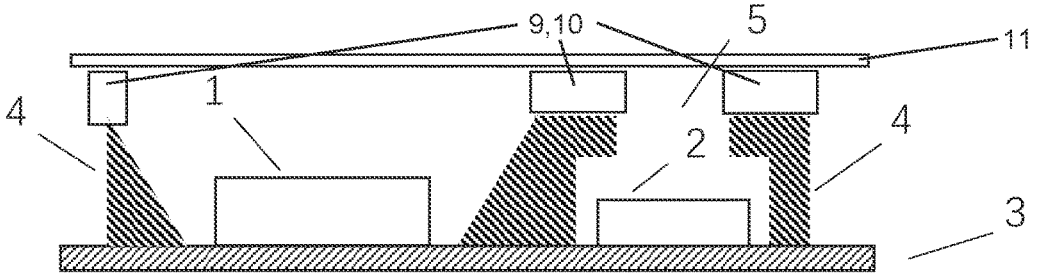
FIG. 4 is a cross-sectional view of a third embodiment of the knock detection device.

FIG. 4 shows a cross-sectional view of a third embodiment of the knock detection device according to the present disclosure. The difference between FIG. 4 and FIG. 3 is that the support structure 4 surrounding the proximity sensor 1 is integrally constructed with the support structure 4 surrounding the sound sensor 2, thus reducing the number of components and facilitating the assembling. Further, the support structure 4 surrounding the sound sensor 2 has an opening 5, which is narrower relative to the side wall. A Helmholtz resonant cavity is advantageously formed by the support structure 4, wherein the opening 5 forms a neck of the Helmholtz resonant cavity and the support structure 4 surrounding the sound sensor 2 forms its cavity. Accordingly, the size of the support structure 4 can be advantageously chosen according to the frequency of sound waves emitted by knocking. In this case, the sound-receiving portion of the sound sensor 2 faces towards the opening 5. Once again, a sound-proof layer 9 composed of potting sealant, conformal coating, double-sided adhesive tape or foam is disposed above the support structure 4. The sound-proof layer 9 is connected to the back side of the panel 11 by a clamping, snap, threaded, adhesive, rivet or welding connection 10.

Figure 5:
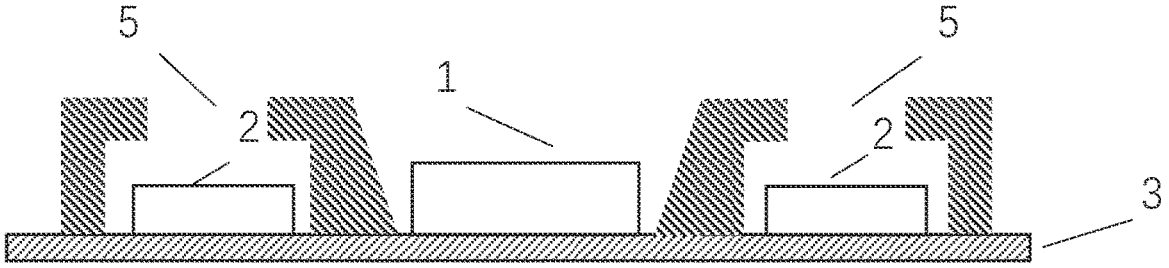
FIG. 5 is a cross-sectional view of a fourth embodiment of the knock detection device.

FIG. 5 shows a cross-sectional view of a fourth embodiment of the knock detection device according to the present disclosure. In this case, the knock detection device has one proximity sensor 1 and two sound sensors 2. The two sound sensors 2 are respectively disposed on two sides of the proximity sensor 1. The two sound sensors 2 and the proximity sensor 1 are respectively surrounded by the corresponding support structures 4. Knocks on the left and right sides of the proximity sensor 1 can be detected by the knock detection device in FIG. 5. In this case, the signal processor 3 can be provided with corresponding comparators and the like to process the signals from the two sound sensors, so as to recognize a knocking position. It is also conceivable that there can be more sound sensors 2 disposed around the proximity sensor 1.

Figure 6:
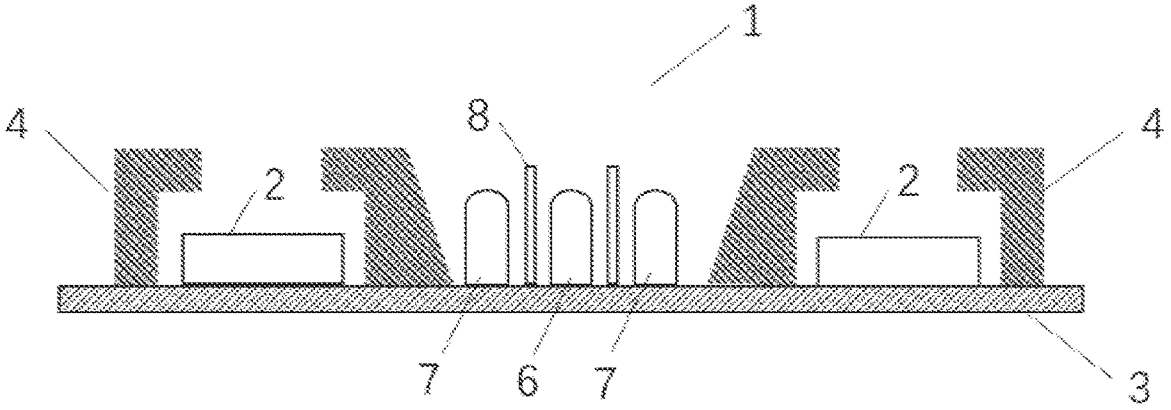
FIG. 6 is a cross-sectional view of a fifth embodiment of the knock detection device.

FIG. 6 shows a cross-sectional view of a fifth embodiment of the knock detection device according to the present disclosure. The difference between FIG. 6 and FIG. 5 is that the proximity sensor 1 includes one infrared LED 6 and two infrared receiving tubes 7. The infrared LED 6 and the two infrared receiving tubes 7 can detect the presence and/or movement of the user based on the infrared reflection principle. In this case, the infrared light emitting tube 6 is provided with a light limiting structure 8, so as to avoid light leakage from the infrared LED to the infrared receiving tube. In this case, the support structure 4 also advantageously constitutes a light limiting structure for the two infrared receiving tubes 7. As can be seen from FIG. 6, one infrared receiving tube 7 is provide beside each respective sound sensor 2, such that the infrared receiving tube can detect the presence and/or movement of a touching object for performing knocking on this side. Accordingly, the signal processing unit 3 receives and/or processes the signal of the sound sensor 2 on this side according to the reflected infrared light received by the infrared receiving tube 7. In this embodiment, additionally, a knocking position can be judged or predicted by the proximity sensor 1, thereby improving the accuracy of knock detection.

Figure 7:
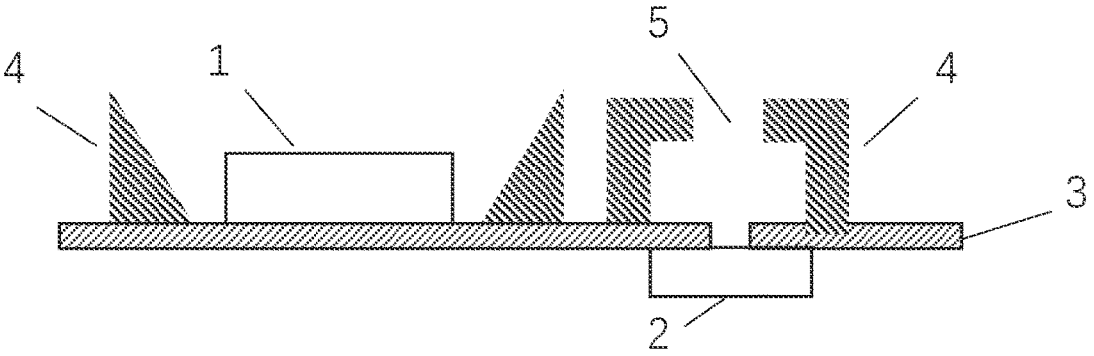
FIG. 7 is a cross-sectional view of a sixth embodiment of the knock detection device.

FIG. 7 shows a cross-sectional view of a sixth embodiment of the knock detection device according to the present disclosure. The difference between FIG. 7 and the above-described embodiments is that the sound sensor 2 is attached to the back side of the signal processing device 3. A microphone provided as the sound sensor 2 is configured as a bottom-receiving microphone, and its sound-receiving portion is aligned with the panel for knocking to be assembled through a hole in the signal processing device 3, which is configured as a circuit board.

Although the present disclosure has been disclosed in preferred embodiments described above, they are not intended to limit the present disclosure. Any person skilled in the art can make possible changes and modifications to the technical solution of the present disclosure using the above-described method and technical content as disclosed without departing from the spirit and scope of the present disclosure. Therefore, with regard to any content not departing from the technical solution of the present disclosure, any simple modifications, equivalent changes and decorations to the above embodiments according to the technical essence of the present disclosure are within the scope of protection of the technical solution of the present disclosure.

The invention claimed is:

1. A knock detection device, comprising:

a support structure having a Helmholtz resonant cavity with an opening forming a neck, said support structure having a size configured according to a frequency of sound waves emitted by knocking;

a proximity sensor;

at least one sound sensor surrounded by said cavity of said support structure, said sound sensor having a sound-receiving portion facing towards said opening; and a signal processing unit;

said proximity sensor and said sound sensor being respectively electrically connected to said signal processing unit; and said signal processing unit at least one of receiving or processing a signal of said sound sensor according to a signal of said proximity sensor;

wherein said proximity sensor includes an infrared LED, two infrared receiving tubes each disposed on one of two opposite sides of said infrared LED, and light limiting structures each disposed between said infrared LED and a respective one of said infrared receiving tubes for detecting at least one of a presence or a movement of a user based on an infrared reflection principle.

2. The knock detection device according to claim 1, which further comprises a support structure at least partially surrounding said proximity sensor.

3. The knock detection device according to claim 2, wherein at least one of said support structures are at least one of higher than or flush with at least one of said proximity sensor or said sound sensor.

4. The knock detection device according to claim 2, wherein said support structure surrounding said proximity sensor has an oblique side wall.

5. The knock detection device according to claim 2, wherein said support structures are made of plastic or foam.

6. The knock detection device according to claim 1, wherein said proximity sensor is an eddy current type, a capacitive type, an inductive type, a thermal inductive type, a magnetic type, a photoelectric type or a microwave radar type proximity sensor.

7. The knock detection device according to claim 1, wherein said sound sensor is a microphone or a piezoelectric sensor.

8. The knock detection device according to claim 7, wherein said microphone is configured as a bottom-receiving microphone having a sound-receiving portion aligned with a panel provided for knocking through a hole in said signal processing device.

9. The knock detection device according to claim 1, wherein said sound sensor is one of a plurality of sound sensors disposed around said proximity sensor.

10. The knock detection device according to claim 1, which further comprises a sound-proof layer composed of potting sealant, conformal coating or foam.

11. A household appliance, comprising:

a panel having a front side provided for knocking and a back side; and a knock detection device according to claim 1, said knock detection device disposed inside the household appliance on said back side of said panel.

12. The household appliance according to claim 11, wherein said knocking detection device is connected to said back side of said panel by clamping, snap connection, thread connection, adhesive connection, rivet connection or welding connection.

13. The household appliance according to claim 11, wherein said knock detection device recognizes at least one tap on said panel selected from the group including: a single-contact tap, a multi-contact tap, a single tap, multiple taps, a tap at a specific beat.

14. The household appliance according to claim 11, wherein the household appliance is a range hood, a refrigerator, an oven, a food processor, a washing machine, an intelligent faucet or an intelligent toilet.

15. The knock detection device according to claim 2, wherein said support structure surrounding said sound sensor and said support structure surrounding said proximity sensor are both part of a single structure.

* * * * *